US006799866B2

(12) United States Patent
Chen

(10) Patent No.: US 6,799,866 B2
(45) Date of Patent: Oct. 5, 2004

(54) PATTERNED FRAME OF A LIGHTING STRING

(76) Inventor: Ching-Huai Chen, 2F-l, No. 152, Nan Yar Street, Hsinchu City (TW)

( * ) Notice: Subject to any disclaimer, the term of this patent is extended or adjusted under 35 U.S.C. 154(b) by 0 days.

(21) Appl. No.: 10/127,457

(22) Filed: Apr. 23, 2002

(65) Prior Publication Data

US 2003/0198047 A1 Oct. 23, 2003

(51) Int. Cl.[7] ..... F21V 21/00

(52) U.S. Cl. ..... 362/249; 362/121; 362/238; 362/252; 362/190; 362/191; 362/239; 362/807

(58) Field of Search ..... 362/249, 238, 362/250, 252, 190, 191, 806, 807, 121, 239; 206/419, 420, 422

(56) References Cited

U.S. PATENT DOCUMENTS 6,017,134 A * 1/2000 Wang ..... 362/252
6,179,441 B1 * 1/2001 Lin ..... 362/252

* cited by examiner

*Primary Examiner*—Stephen Husar
*Assistant Examiner*—Bertand Zeade
(74) *Attorney, Agent, or Firm*—Rosenberg, Klein & Lee

(57) ABSTRACT

The present invention relates to a patterned frame of a lighting string, which includes several similar patterned frames with different dimensions. Each of the patterned frames can be independently use for connecting with the bulb of the lighting string as a decoration. Every patterned frame can be assembled as a single patterned frame for providing a various decorative display.

2 Claims, 2 Drawing Sheets

PATTERNED FRAME OF A LIGHTING STRING

BACKGROUND OF THE INVENTION

In order to increase decorative effect of a lighting string, a patterned frame is provided for connecting with the lighting string with a specific drawing or letter. Such known patterned frame has a unit form and is somehow monotonous. There is possibility to improve the decorative effect of the lighting string.

Accordingly, the primary object of the invention is to provide a patterned frame having several units with different dimension for connecting with the lighting string with various displays that obtains better improvement and utility. Now the features and advantages of the present invention will be described in detail with reference to the accompanying drawings.

BRIEF DESCRIPTION OF ACCOMPANYING DRAWINGS

DETAILED DESCRIPTION OF PREFERRED EMBODIMENTS

Figure 1:
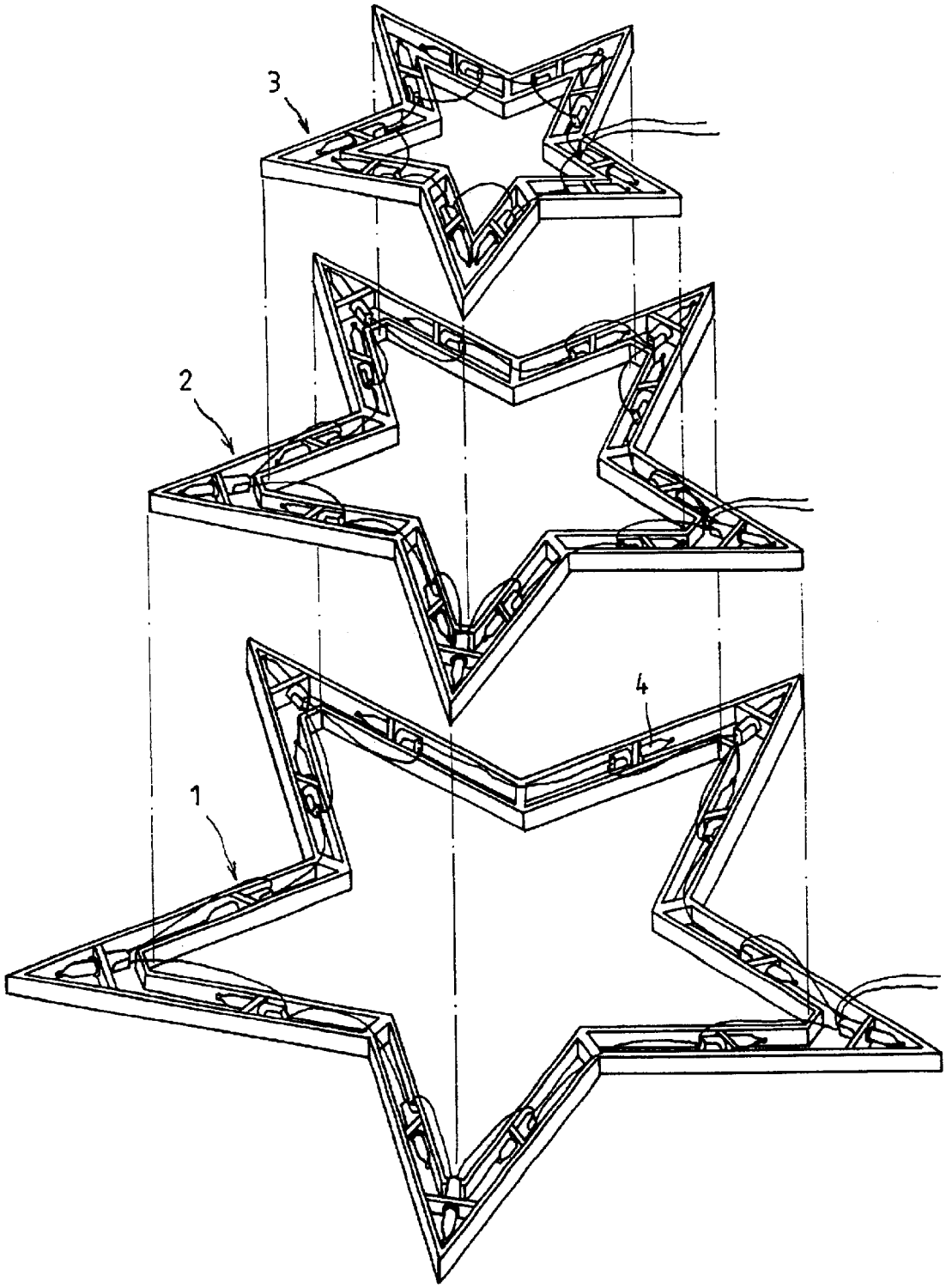
FIG. 1 is an exploded perspective view showing a patterned frame of a lighting string according to the present invention.
Figure 2:
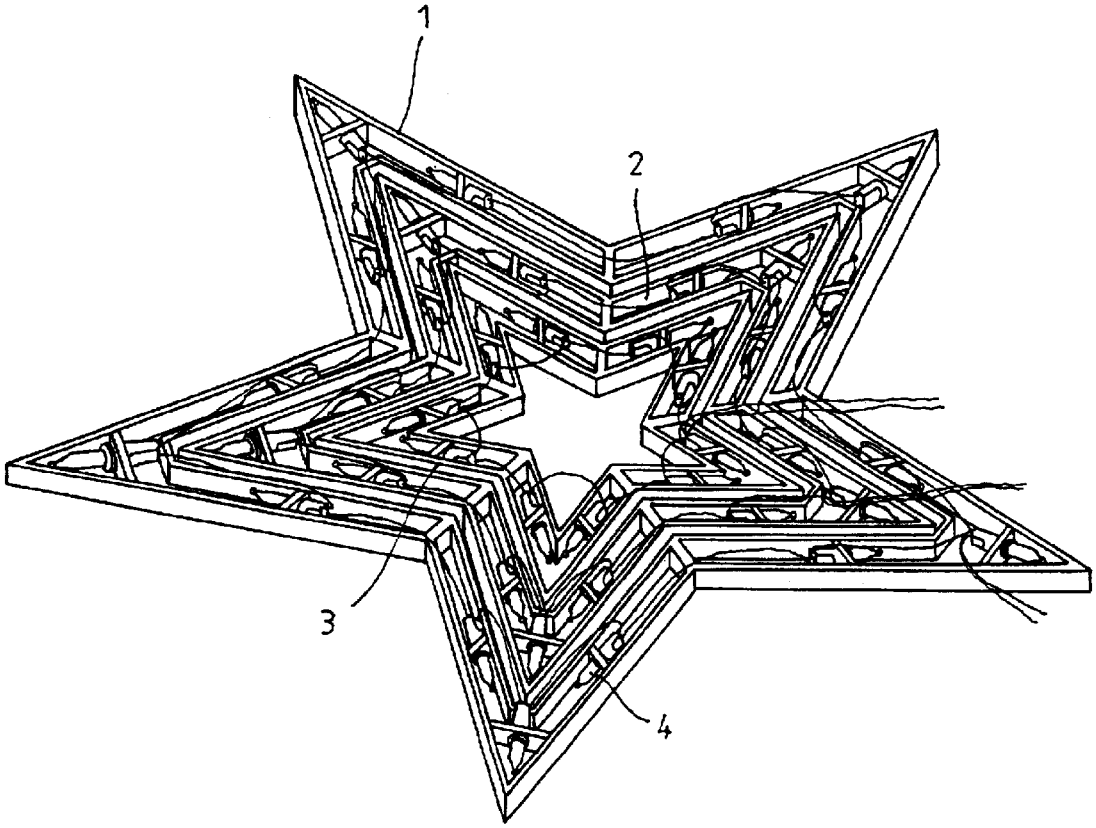
FIG. 2 is an assembled perspective view of FIG. 1.

Please refer to FIGS. 1 and 2, the present invention relates to a patterned frame of a lighting string, which can be designed as any suitable figure, such as circular, polygonal, heart-typed, and so on, wherein a star-shape frame is disclosed in the invention. Furthermore, there can be two or more similar frames with different dimensions according to this invention, and there are three frames illustrated for example in this embodiment. Thus, it includes a large patterned frame (1), a middle patterned frame (2), and a small patterned frame (3). Each frame can be connected with bulbs (4) of the lighting string for independent use. Further, due to each patterned frame has different dimension and similar shape, the small frame (3) can just engaged within the middle frame (2), while the middle frame (2) is engaged within the large patterned frame (1). An assembled patterned frame including three patterned frames (1), (2), (3) becomes a single decorative structure that provides a various displaying effect with increasing utilization.

Accordingly, a characteristic of the present invention is to provide a decorative structure, which can be assembled by several similar patterned frames and can be formed with various shapes. It obtains a perfect decorative effect, which will be better than ever.

Above all, the invented assembly of the present invention obviously obtains utility and improvement. It should be allowed for patent and is applied.

What is claimed is:

1. A pattered frame of a system of lighting strings comprising:

(a) a first frame having a first set of electric lights, said first frame further having a predetermined contour and defining an open central section having a contour corresponding to said predetermined contour wherein said first frame has an outer perimeter and an inner perimeter;

(b) a second frame having a second set of electric lights, said second frame further having a similar contour to said first frame and defining an open central section having a contour corresponding to said similar contour, wherein said second frame has an outer perimeter an an inner perimeter an said second frame is reversibly insertable within said open central section of the first frame in a nested interfacing relation thereto so that corresponding portions of said inner perimeter of said first frame and said outer perimeter of said second frame are in a juxtaposed and substantially contiguous relationship; and (c) said first set of electric lights and said second set of electric lights being electrically independent of each other.

2. A patterned frame of a system of lighting string as recited in claim 1 including a third frame having a third set of electric lights being electrically independent of said first and second sets of electric lights, said third frame having a contour similar to said contour of said first and second frames, wherein said third frame has an outer perimeter and an inner perimeter and said inner perimeter of the third frame defines an open central section having said predetermined contour and said third frame in reversibly insertable within said open central section of the second frame in a nested interfaceing relation thereto so that corresponding portions of said inner perimeter of said second frame and said outer perimeter of said third frame are in a juxtaposed and substantially contiguous relationship.

* * * * *